US007125002B2

(12) United States Patent
Platt

(10) Patent No.: US 7,125,002 B2
(45) Date of Patent: Oct. 24, 2006

(54) FENCE RAIL MOUNTING CLIP

(76) Inventor: Robert E. Platt, 8701 Highland Ave., Mineral Ridge, OH (US) 44440

( * ) Notice: Subject to any disclaimer, the term of this patent is extended or adjusted under 35 U.S.C. 154(b) by 0 days.

(21) Appl. No.: 10/967,403

(22) Filed: Oct. 18, 2004

(65) Prior Publication Data

US 2006/0081829 A1 Apr. 20, 2006

(51) Int. Cl.
*E04H 17/14* (2006.01)

(52) U.S. Cl. ..... 256/65.04; 256/65.02; 256/65.03

(58) Field of Classification Search ..... 256/1, 256/59, 65.01–65.05, 65.08, 65.16, 66, 68, 256/70; 248/218.4, 219.3–219.4, 316.7, 248/224.7, 225.11, 226.1
See application file for complete search history.

(56) References Cited

U.S. PATENT DOCUMENTS

| | | | | |
|---|---|---|---|---|
| 2,886,278 | A | 5/1959 | Opie | |
| 2,904,314 | A | 9/1959 | Thom | |
| 3,051,426 | A | 8/1962 | Wagner | |
| 4,835,852 | A | 6/1989 | Asplund et al. | |
| 4,929,116 | A | 5/1990 | Mahl | |
| 5,083,331 | A | 1/1992 | Schnelle et al. | |
| 5,244,300 | A | 9/1993 | Perreira et al. | |
| 5,362,030 | A * | 11/1994 | Iler et al. | 256/65.08 |
| 5,544,865 | A | 8/1996 | Abbaticchio | |
| 5,544,866 | A | 8/1996 | Dye | |
| 5,560,588 | A * | 10/1996 | Hilliard | 256/65.06 |
| 5,720,567 | A * | 2/1998 | Rinderer | 403/314 |
| 5,788,224 | A | 8/1998 | Platt | |
| 5,873,671 | A | 2/1999 | West | |
| 6,126,148 | A * | 10/2000 | Lesenskyj | 256/65.02 |
| 6,308,937 | B1 * | 10/2001 | Pettit | 256/65.05 |
| 6,905,109 | B1 * | 6/2005 | Mills | 256/65.02 |
| 6,935,623 | B1 * | 8/2005 | Cook et al. | 256/65.08 |

* cited by examiner

*Primary Examiner*—Daniel P. Stodola
*Assistant Examiner*—Joshua T. Kennedy
(74) *Attorney, Agent, or Firm*—Sand & Sebolt

(57) ABSTRACT

A fence rail mounting clip for connecting a hollow fence rail to a vertical post. The mounting clip includes a base that is selectively interlockable with a bracket. The bracket has a front surface with a peripheral wall extending normal to and outwardly therefrom to define a fence rail receptacle for receiving an end of the rail therein. A rail support extends normal to and outwardly from the front surface of the bracket from a position within the rail receptacle. The rail support is separated from the peripheral wall by a gap. The rail support terminates in an outermost edge which lies further from the front surface of the bracket than does the outermost edge of the peripheral wall. When the rail is received in the rail receptacle, the walls of the rail are received within the gap between the rail support and peripheral wall and are wedged therebetween, and the rail support extends into the bore of the hollow rail.

27 Claims, 10 Drawing Sheets

FENCE RAIL MOUNTING CLIP

BACKGROUND OF THE INVENTION

1. Technical Field

This invention generally relates to fences. More particularly, the invention relates to a clip for mounting vinyl fence rails to vertical fence posts. Specifically, the invention relates to a clip that includes a rail support which projects from its front surface and is receivable within the bore of a hollow fence rail.

2. Background Information

Fences are used in today's society for a variety of reasons and are available in a variety of different styles and types. For example, farmers use fences to contain their livestock, to prohibit entry of predators and to protect their crops. Businesses use fences to keep thieves and trespassers off of the premises. Residents use fences to keep their children and pets within their property limits or for ornamental or aesthetic purposes.

Conventionally, these fences are constructed of wood, rock or wire, each of which has its advantages and disadvantages. Wooden fences frequently need painting. Additionally, wooden fences are assembled by forming a slot in a vertical fence post through which a slatted end of the fence rail extends to mount the fence rail to the post. These slots allow water to enter and sit therein, subjecting the fence posts to water damage and rotting. Furthermore, wooden rails are heavy and dangerous to assemble. Rock fences are difficult to construct and are dangerous if the heavy fence wall begins to crumble. Wire fences rust, making them unpleasing to the eye and impractical for residential use.

Alternatives to these conventional fencing materials are plastic or vinyl fences. Vinyl fences are aesthetically pleasing, are relatively easy to install and never rot or need painting. The problem with vinyl and plastic fencing is that it is difficult to connect the horizontally extending fence rails to the vertically extending fence posts.

This problem has been previously addressed by the present inventor in U.S. Pat. No. 5,788,244, which issued Aug. 4, 1998. The patent discloses a fence rail clip for connecting a hollow fence rail to a vertical fence post. The fence rail clip includes a base mountable to the fence post and a locking bracket which is securable to the hollow fence rail. The locking bracket has a front surface with a peripheral wall extending outwardly at about ninety degrees from the front surface and a fence rail receptacle is formed between the front surface and the peripheral wall. The peripheral wall is sized and shaped to be complementary to the cross-section of the end of the fence rail. The end of the fence rail slides into the rail receptacle and the bracket is interlocked with the base. The peripheral wall of the locking bracket tends to prevent lateral movement of the end of the rail. The end of the rail may accidentally be pulled out of the rail receptacle during installation of the fence or the rail may be accidentally knocked out of the receptacle after the fence has been assembled.

There is therefore a need in the art for an improved fence rail mounting clip that resists the tendency of the rail end to be pulled out of the locking bracket when the opposite end of the rail is being handled.

SUMMARY OF THE INVENTION

A fence rail mounting clip for connecting a hollow fence rail to a vertical post. The mounting clip includes a base that is selectively interlockable with a bracket. The base is attachable to the vertical fence post and the bracket is adapted to receive and end of the hollow fence rail and to secure thereto. The bracket has a front surface with a peripheral wall extending normal to and outwardly therefrom to define a fence rail receptacle for receiving an end of the rail therein. A rail support extends normal to and outwardly from the front surface of the bracket from a position within the rail receptacle. The rail support has an outermost edge that extends beyond the outermost edge of the peripheral wall. The rail support is separated from the peripheral wall by a gap. When the rail is received in the rail receptacle, the walls of the rail are received within the gap between the rail support and the peripheral wall and become wedged therebetween and the rail support extends into the bore of the hollow rail to aid in supporting the rail and preventing lateral movement of the rail.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
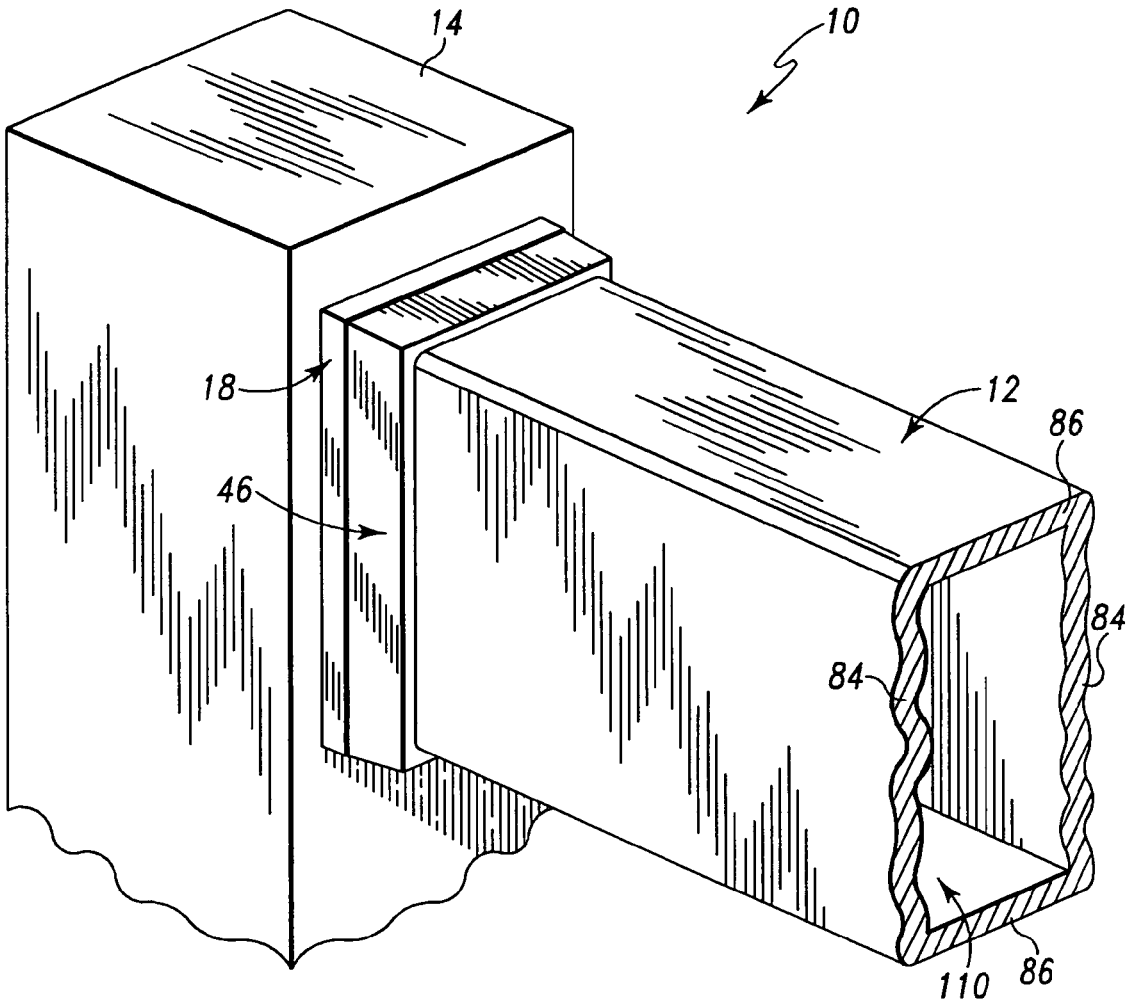
FIG. 1 is a fragmentary perspective view of a first embodiment of a fence rail clip in accordance with the present invention and shown attaching a fence rail to a fence post.
Figure 2:
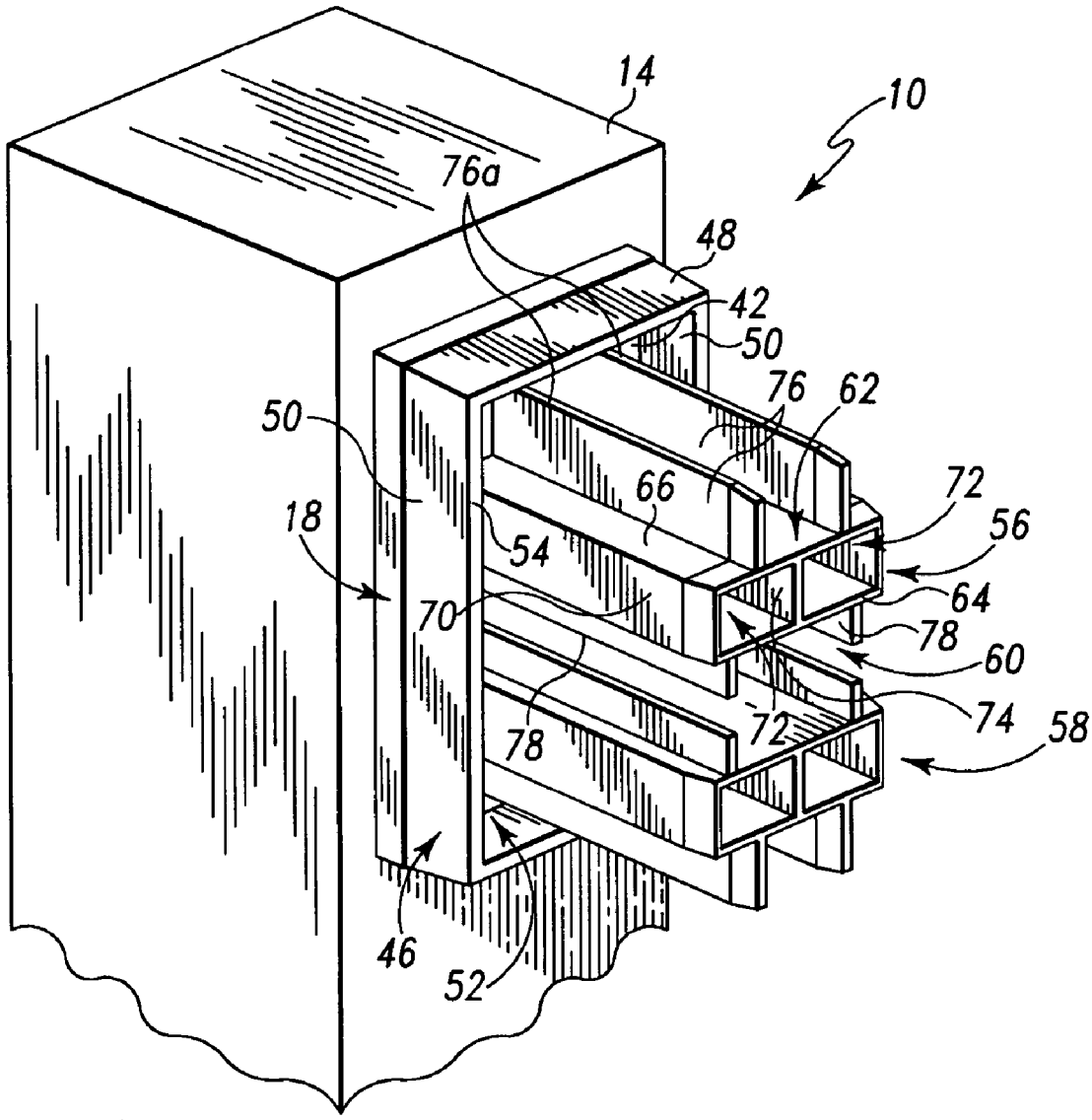
FIG. 2 is perspective view of the fence rail clip of FIG. 1, with the fence rail removed.
Figure 3:
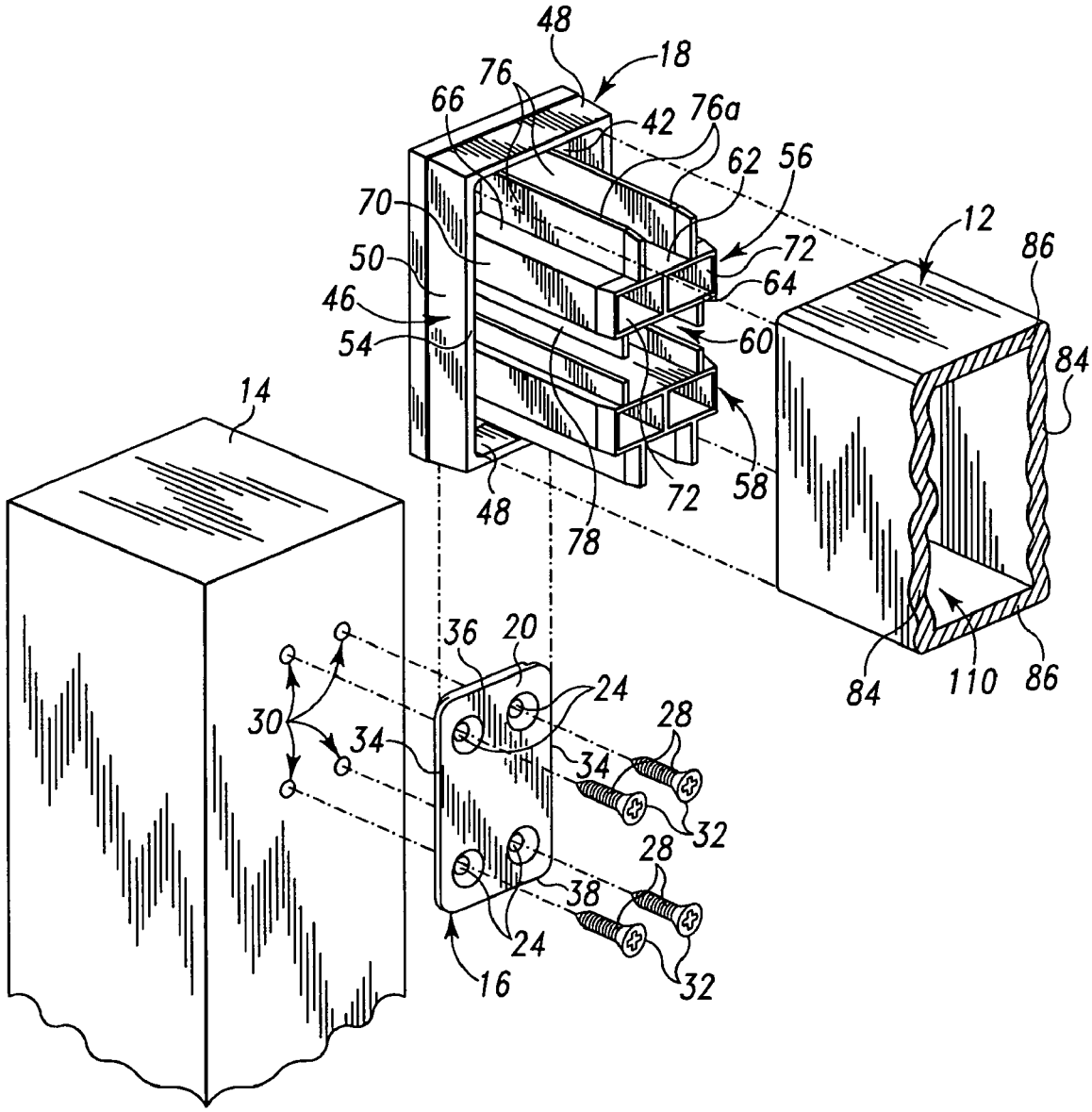
FIG. 3 is an exploded fragmentary perspective view similar to FIG. 1.

Referring to FIGS. 1–7, the fence rail clip of the present invention is indicated generally at 10 and is shown in FIG. 1 attaching a fence rail 12 to a fence post 14. Fence rail 12 preferably is a hollow member molded from vinyl and is connectable to a substantially rectangular or square vinyl fence post 14 by clip 10. Clip 10 is molded from a resilient plastic material and includes a base, generally indicated at 16 (FIG. 3), and a locking bracket generally indicated generally at 18. Base 16 is secured to post 14 and locking bracket 18 engages base 16.

Base 16, shown particularly in FIGS. 3, 6–8 and 10, preferably is rectangular-shaped and has front and rear surfaces 20 and 22, respectively. Two pairs of circular holes 24 are formed through base 16, with each hole 24 having an enlarged counterbore 26 formed in front surface 20. Two pairs of screws 28 may be inserted through holes 24 and into two pairs of holes 30 drilled in post 14 which are axially aligned with holes 24. Screws 28 include a screw head 32 which sits within counterbore 26 in base when base 16 is mounted on fence post 14, as described below. A peripheral outer edge 34 of base is chamfered inwardly from front surface 20 to rear surface 22 (FIG. 8) so that rear surface 22 is smaller than front surface 20. When base 16 is viewed from the side (FIG. 10) it may be seen that base is formed so as to have narrowed portion 23 proximate rear surface 22 and a wider portion 25 proximate front surface 20. Base 16 further has an upper edge 36 and a lower edge 38.

In accordance with the present invention and referring to FIGS. 1–11, locking bracket 18 includes a flat, generally rectangular-shaped panel 40 having a front surface 42 and a rear surface 44. A peripheral wall 46 extends outwardly from front surface 42 and substantially at ninety degrees thereto. Peripheral wall 46 has ends 48 and sides 50. Peripheral wall 46 and front surface 42 define a fence-rail receptacle 52 (FIG. 2) for receiving an end of rail 12 therein. Peripheral wall 46 extends outwardly for a distance from front surface 42 and terminates in an outermost edge 54. A pair of rail supports 56, 58 extend outwardly from front surface 42 of bracket 18 and from within receptacle 52. While the preferred embodiment of the invention is shown with two supports 56, 58, it will be understood that only one rail support or more than two supports may be provided. Supports 56, 58 are structurally and functionally substantially identical to one another and are separated from each other by a space 60. The structure of support 56 will be hereinafter described in greater detail, but it will be understood that the description applies equally to support 58. Support 56 comprises an elongated rib 62 which extends normal to and outwardly from front surface 42 of bracket 18. Rib 62 terminates at an outermost edge 64. Outermost edge 64 lies at least the same distance, and preferably at a greater distance, from front surface 42 than does outermost edge 54 of peripheral wall 46. Rib 62 has an outer wall 66, an inner wall 68 and side walls 70. Rib 62 also includes a number of chambers 72 separated from each other by connecting walls 74. Chambers 72 are provided to reduce the weight of the fence rail clip. Connecting walls 74 increase the structural strength of rail clip 10. Rib 62 has a longitudinal axis which is disposed normal to front surface 42 of bracket 18. At least one, and preferably two, first flanges 76 extend outwardly from outer wall 66 of rib 62. Flanges 76 are disposed normal to the longitudinal axis of rib 62 and extend outwardly from outer wall 66 of rib 62 toward peripheral wall 46 of bracket 18. Flanges 76 run the entire length of rib 62 from front surface 42 to outermost edge 64. Flanges 76 each terminate in a ridge **76*a* and at least a front portion of ridge 76*a*, proximate outermost edge 64, is tapered to allow for easier sliding engagement of rail 12 with flanges 76. A pair of spaced second flanges 78 preferably extend outwardly from and normal to inner wall 68 of rib 62 and into space 60. Second flanges 78 run the entire length of rib 62 from front surface 42 to outermost edge 64 and are preferably spaced further apart from each other than are first flanges 76. Second flanges 78 provide additional strength to rail support 56. Side walls 70 of rib 62 are tapered proximate outermost edge 64 so as to allow for easier sliding engagement with rail 12**.

Figure 5:
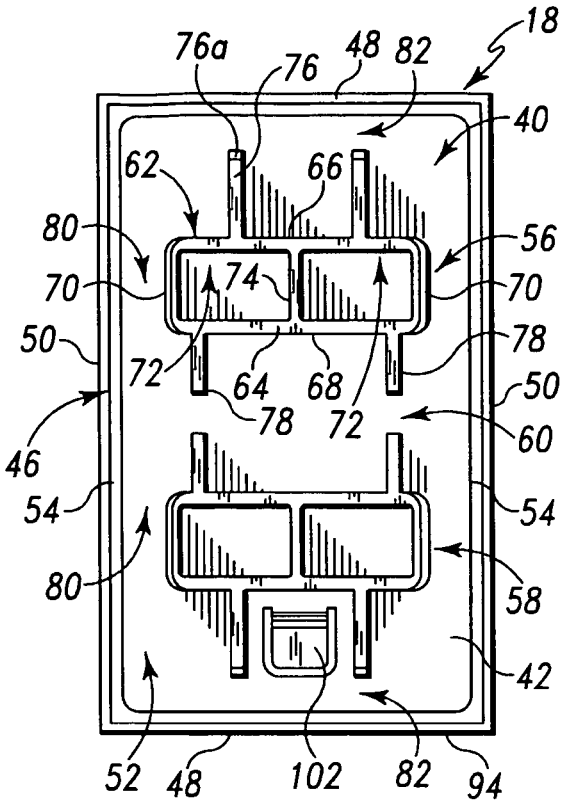
FIG. 5 is a front elevational view of the locking bracket of FIG. 4.
Figure 6:
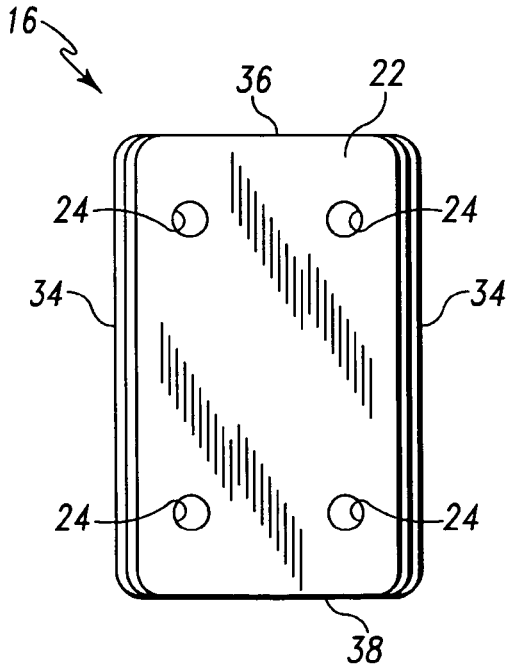
FIG. 6 is a rear elevational view of the base of the clip of FIG. 1.
Figure 7:
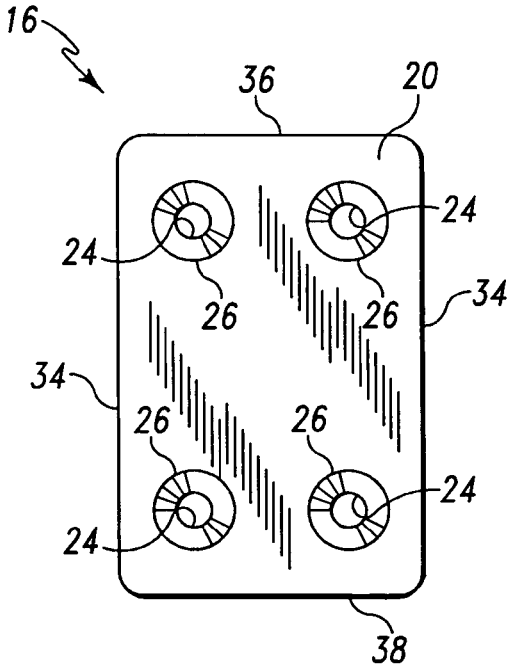
FIG. 7 is a front elevational view of the base of FIG. 6
Figure 8:
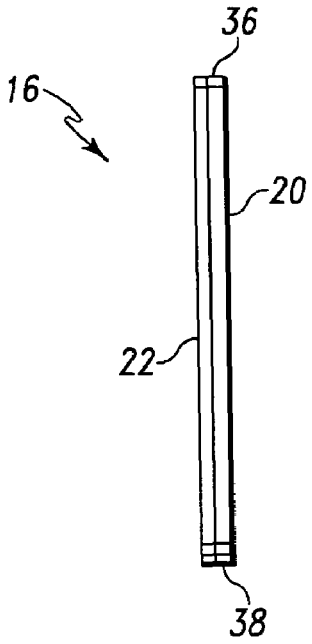
FIG. 8 is a side elevational view of the base.
Figure 9:
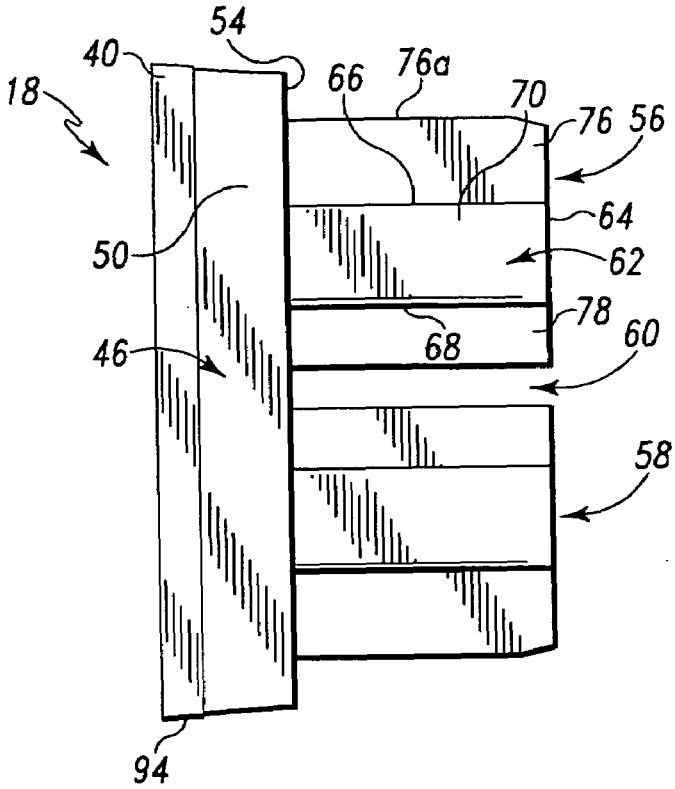
FIG. 9 is a side elevational view of the locking bracket.

As may be most clearly seen in FIG. 5, a gap 80 is formed between side walls 70 of rib 62 and sides 50 of peripheral wall 46. A gap 82 is formed between ridges **76*a* of flanges 76 and ends 48 of peripheral wall 46. Gaps 80 and 82 are sized to respectively receive side walls 84 and end walls 86 of rail 12 therein, as will be described hereinbelow. Gaps 80 and 82 are complementary sized and shaped to received side and end walls 84, 86 of rail 12. Gaps 80, 82 are wide enough to allow side and end walls 84, 86 to enter gaps 80, 82, but are sufficiently narrow to cause side and end walls 84, 86 to be wedged between the rail supports 56, 58 and peripheral wall 46** and to therefore be interferencely fitted therein.

Figure 4:
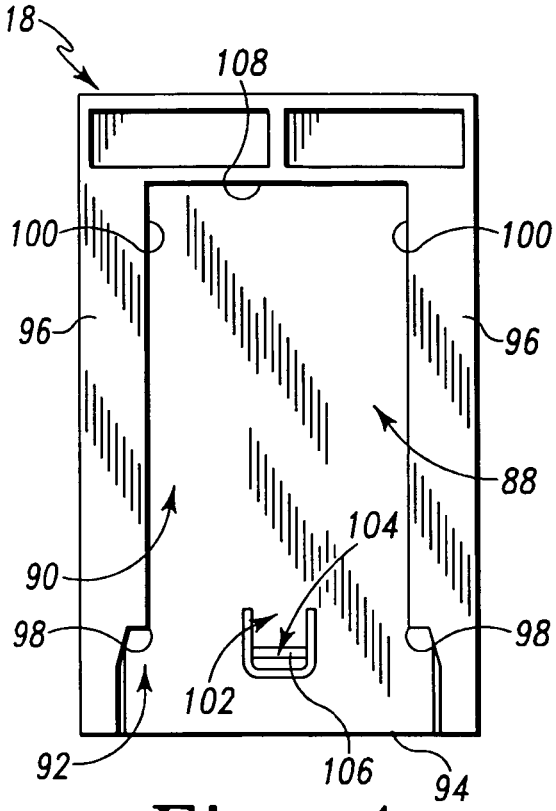
FIG. 4 is a rear elevational view of the locking bracket of the clip shown in FIG. 1.
Figure 10:
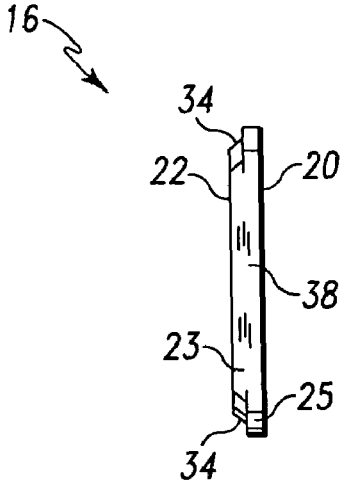
FIG. 10 is a bottom view of the base of FIG. 8.
Figure 11:
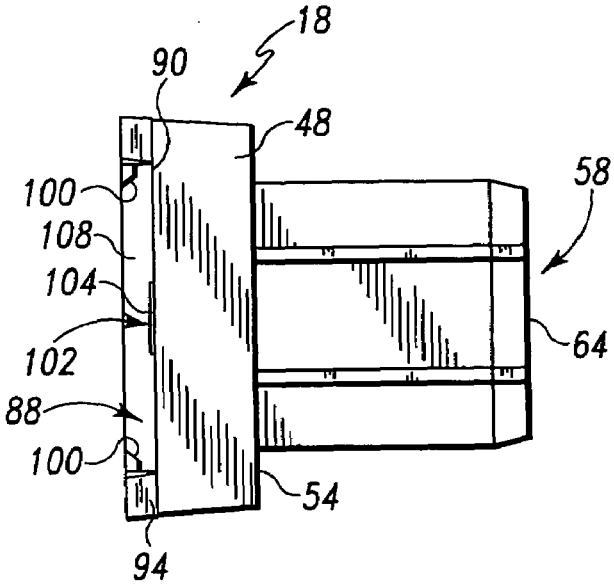
FIG. 11 is a bottom view of the locking bracket of FIG. 9.

Referring particularly to FIGS. 4, 10 and 11, rear surface 22 of panel 40 includes a recessed portion 88 for engaging base 16. Recessed portion 88 has an inner, substantially rectangular slotted section 90 and an outwardly angled section 92. Section 92 opens proximate the lower edge 94 of bracket 18 to slidably receive base 16 therein. Section 90 is complementary sized and shaped to receive wider portion 25 of base 16 therein, as described below. Panel 40 forms a leg 96 on either side of recessed portion 88 and an elbow 98 is formed at the junction of sections 90 and 92. The inner peripheral edges 100 of legs 96 are chamfered (FIG. 11) so that they are complementary shaped to the outer peripheral edges 34 of base 16.

Figure 14:
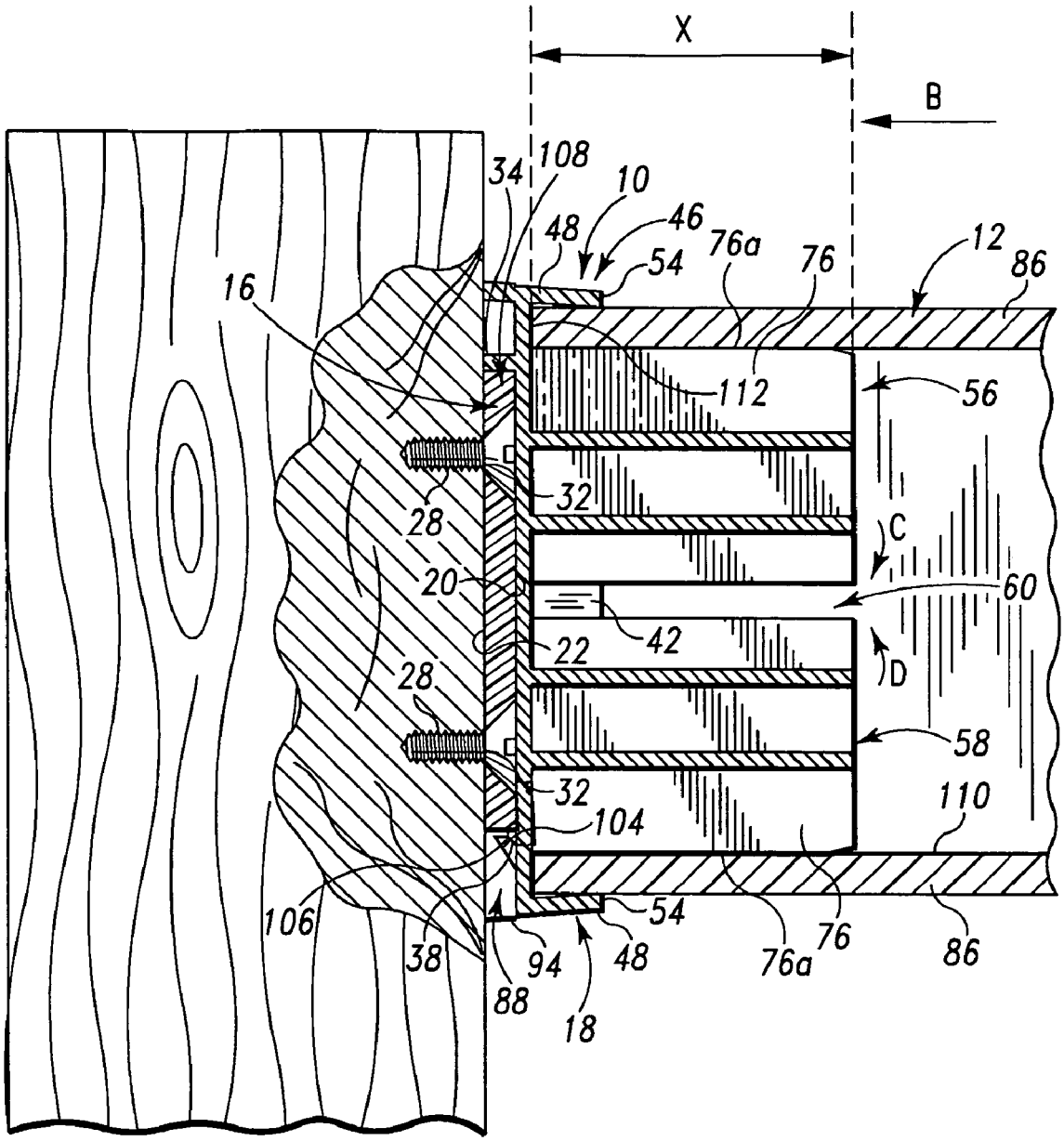
FIG. 14 is a partial cross-sectional side view of the locking bracket mounted on the post and holding a fence rail therein.

Referring to FIGS. 4, 5 and 14, a catch 102 is formed in panel 40 within recessed portion 88 and between elbows 98 when bracket 18 is viewed from the back. Catch 102 lies between flanges 76 when bracket 18 is viewed from the front and comprises a segment of panel 40 around which a U-shaped section of material has been removed. Catch 102 includes a detent 104 that extends outwardly from the rear surface 44 of bracket 18. Detent 104 includes an angled face 106 that enables base 16 to slide over catch 102 and force it to swing out of the way when base 16 and bracket 18 engage, as will be described hereinafter. In its rest position, catch 102 lies coplanar with rear surface 44 of bracket 18.

Figure 12:
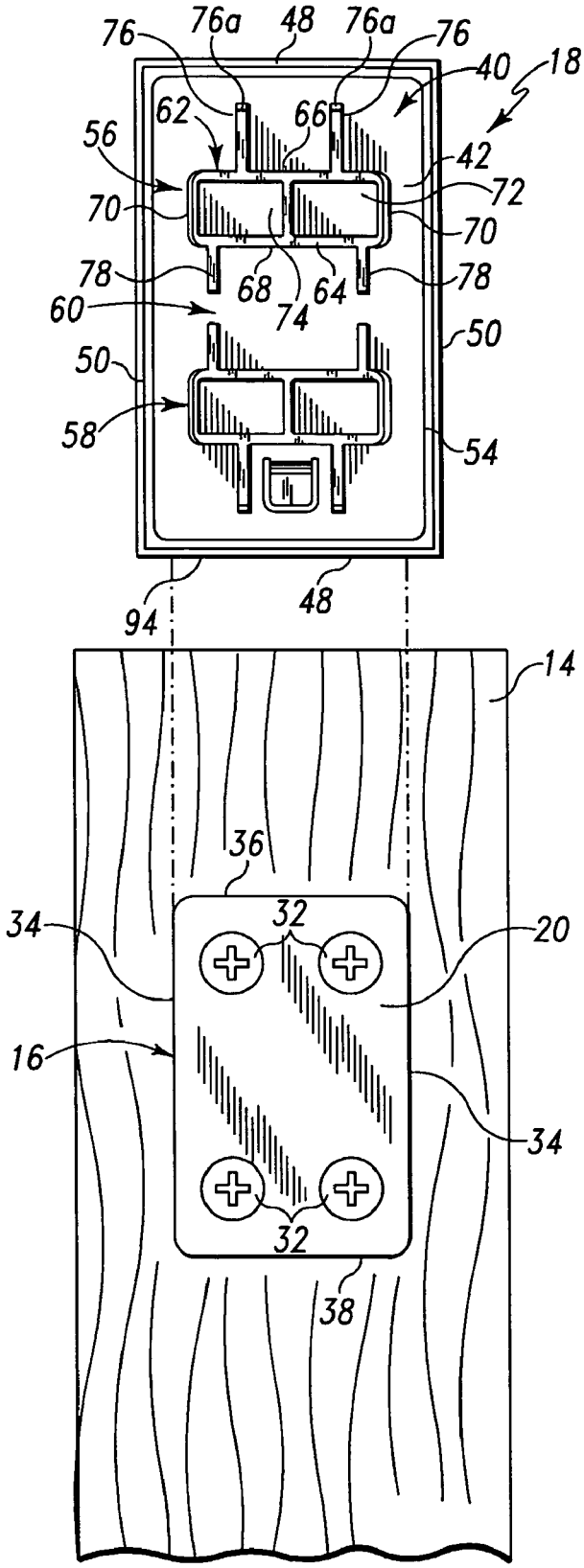
FIG. 12 is a front elevational view showing the locking base moving into engagement with the base.
Figure 13:
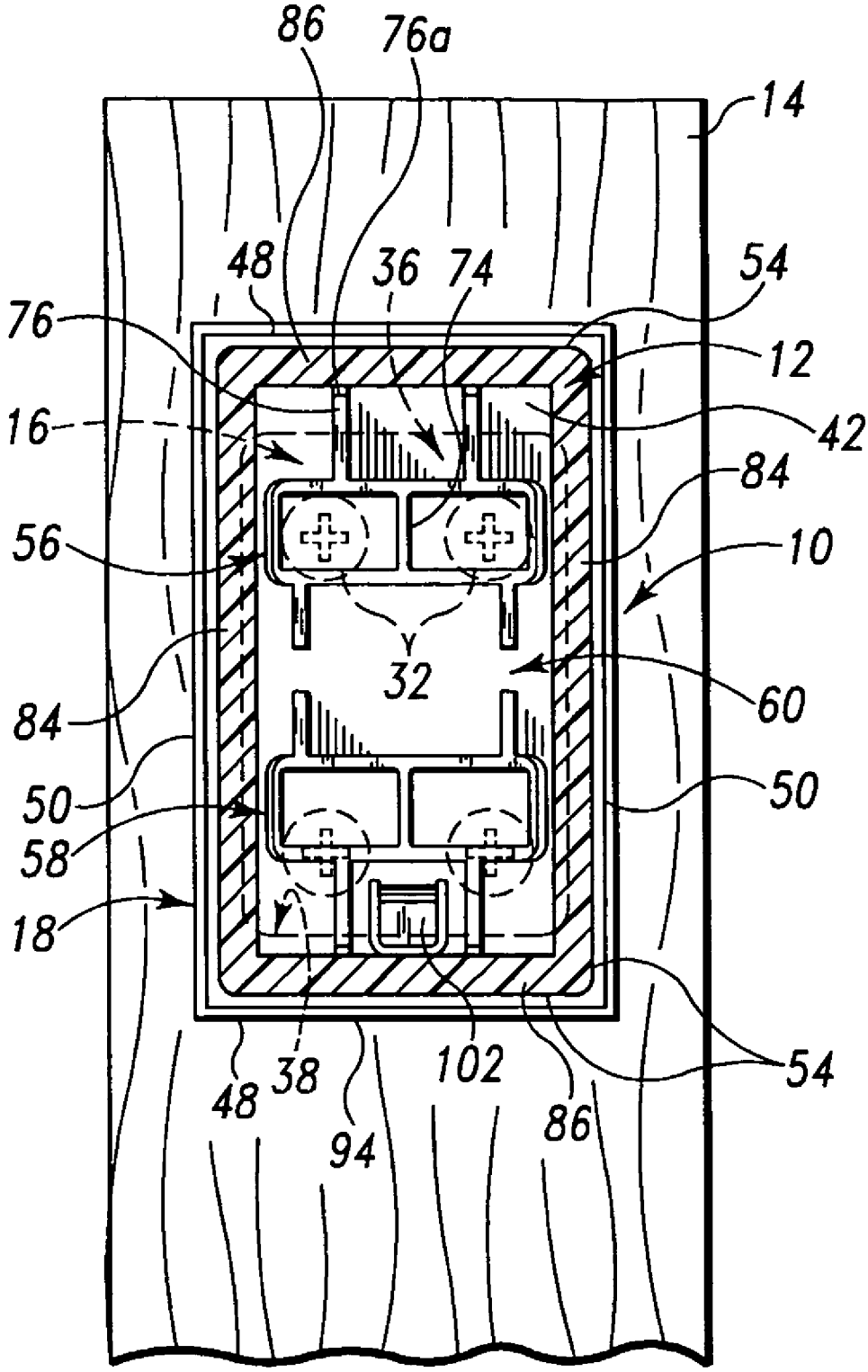
FIG. 13 is a front elevational view showing the locking bracket engaged with the base.

Referring to FIGS. 12–14, in use, a fence installer drills holes 30 in fence post 14 to axially align with holes 24 of base 16. The installer positions rear surface 22 of base 16 against fence post 14 and aligns holes 24 with holes 30. The installer inserts screws 28 through holes 24 and 32 and tightens screws 28 until each heads 32 sits within its respective counterbore 26 and thereby firmly secure base 16 to post 14.

The installer connects locking bracket 18 to base 16 by positioning rear surface 44 of locking bracket 18 above upper edge 36 of base 16 and snap-fits or operatively interlocks locking bracket 18 with base 16 by sliding bracket 18 downwardly over base 16 in the direction of the arrow "A" (FIG. 12). Outwardly angled section 92 of recessed portion 88 guides bracket 18 over base 16. Front surface 20 of base 16 slides along rear surface 44 of panel 40 and complementary tapered edges 34 and 100 of base 16 and recessed portion 88, respectively, cam against one another as bracket 18 is pushed downwardly in the direction of arrow "A". As base 16 slides over face 106 of catch 102, catch 102 is forced out of alignment with rear surface 44 and allows base 16 to slide into recessed portion 88. Wider portion 25 of base 16 is received in slotted section 90 of locking bracket 18 and locking bracket 18 is pushed downwardly until the upper edge 36 of base 16 abuts the inner edge 108 of locking bracket 18 (FIG. 14). Once lower edge 38 of base 16 slides past detent 104, catch 102 springs back into coplanar alignment with rear surface 44. Detent 104 lies below lower edge 38 of base 16 and substantially secures bracket 18 and base 16 together.

The end of fence rail 12 is secured to locking bracket 18 by sliding rail 12 over rail supports 56, 58 in the direction of arrow "B" (FIG. 14) thereby causing rail supports 56, 58 to enter bore 110 of rail 12. As end walls 86 of rail 12 slide over flanges 76 of rail supports 56, 58, supports 56, 58 flex into space 60 and slightly toward each other as indicated by the arrows "C" and "D" in FIG. 14. This slight inward movement of supports 56, 58 allows end walls 86 of rail 12 to slide over ridges 76*a* of flanges 76. Simultaneously, side walls 84 of rail 12 engage sides 70 of ribs 62. Rail 12 is moved in the direction of arrow "B" until the front edge 112 of rail 12 enters gaps 80 and 82 in bracket 18. Rail 12 is moved in direction of arrow "B" until front edge 112 of rail 12 abuts front surface 42 of locking bracket 18. When rail 12 is in this position, supports 56, 58 extend a distance "X" into the bore 110 of rail 12 and end and side walls 86 and 84 of rail 12 are wedged between rail supports 56, 58 and peripheral wall 46 of locking bracket 18.

It will be understood that base 16 and recessed portion 88 in locking bracket 18 need not be rectangular in shape, but may be oval or any other suitable shape that allows base 16 and bracket 18 to interlock with each other. Furthermore, bracket 18 and peripheral wall 46 may be differently shaped so as to accommodate rails that are not rectangular in cross-section. For example, if rail is circular in cross-section, at least the peripheral wall may be circular in cross-section to define a substantially circular cross-sectional rail receptacle. It will further be understood that while two supports 56, 58 are shown extending outwardly from front surface 42 of panel 40, a lesser or greater number of supports may be provided without departing from the spirit of the present invention. Flanges 76 are adapted to contact the end walls 86 of rail 12 and side walls 70 of ribs 62 are adapted to contact side walls 84 of rails. Flanges 76 could, however, be made to contact side walls 84 of rail 12 and side walls 70 of ribs 62 could contact end walls 86 without departing from the spirit of the invention. Furthermore, the order of connection of the locking bracket 18 to base 16 and connection of the rail 12 to the locking bracket 18 may be reversed.

Figure 15:
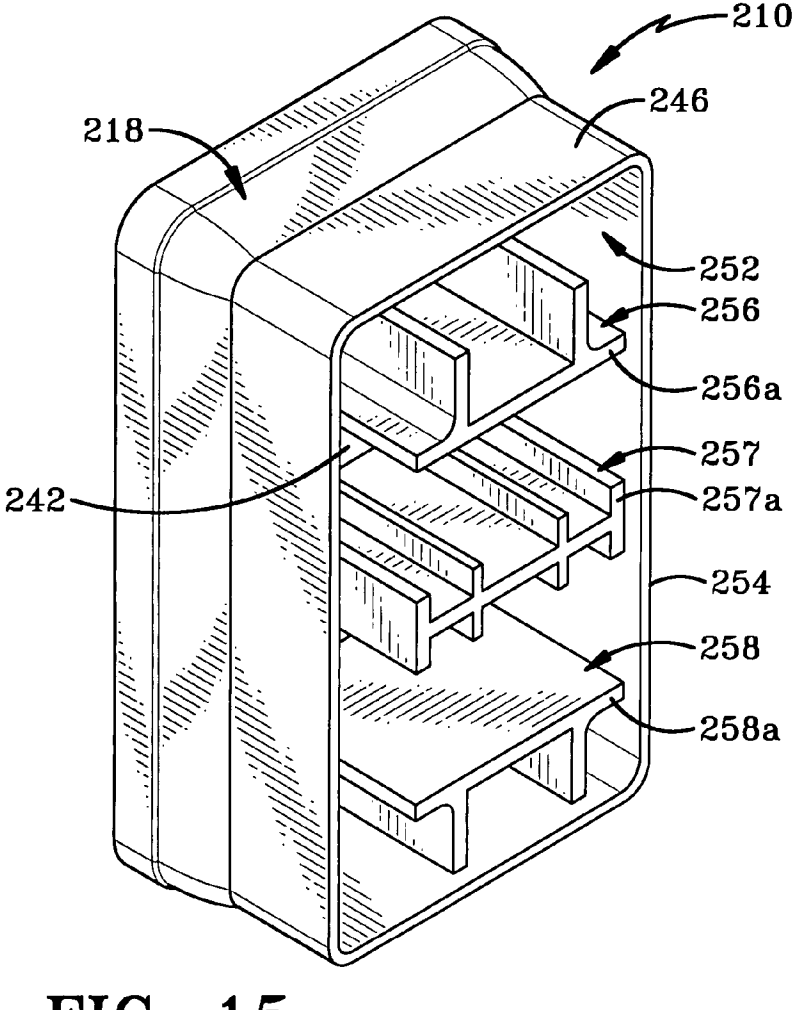
FIG. 15 is a perspective view of a second embodiment of the fence rail clip in accordance with the present invention.

Referring to FIG. 15, there is shown a second embodiment of the rail clip in accordance with the present invention and generally indicated at 210. As with the first embodiment, clip 210 is adapted to be mounted to a post (not shown) and to receive a rail (not shown) therein. Clip 210 includes a locking bracket 218 having a peripheral wall 246 extends outwardly from front surface 242 thereof. Peripheral wall 246 and front surface 242 define a fence-rail receptacle 252 for receiving an end of rail therein. A plurality of rail supports 256, 257 and 258 extend outwardly from front surface 242 of bracket 218 and from within receptacle 252. Supports 256, 257 and 258 are separated from each other and from peripheral wall 246. Peripheral wall 246 terminates in an outer edge 254 and supports 256, 257, 258 each terminate in an outer edge 256*a* which extend at least as far from front surface 242 as does outer edge 254 of peripheral wall 246. Preferably, outer edges 256*a*, 257*a* and 258*a* extend further outwardly from front surface 242 than does outer edge 254 of peripheral wall 246. Rail clip 210 functions in essentially the same manner as does rail clip 10.

Figure 16:
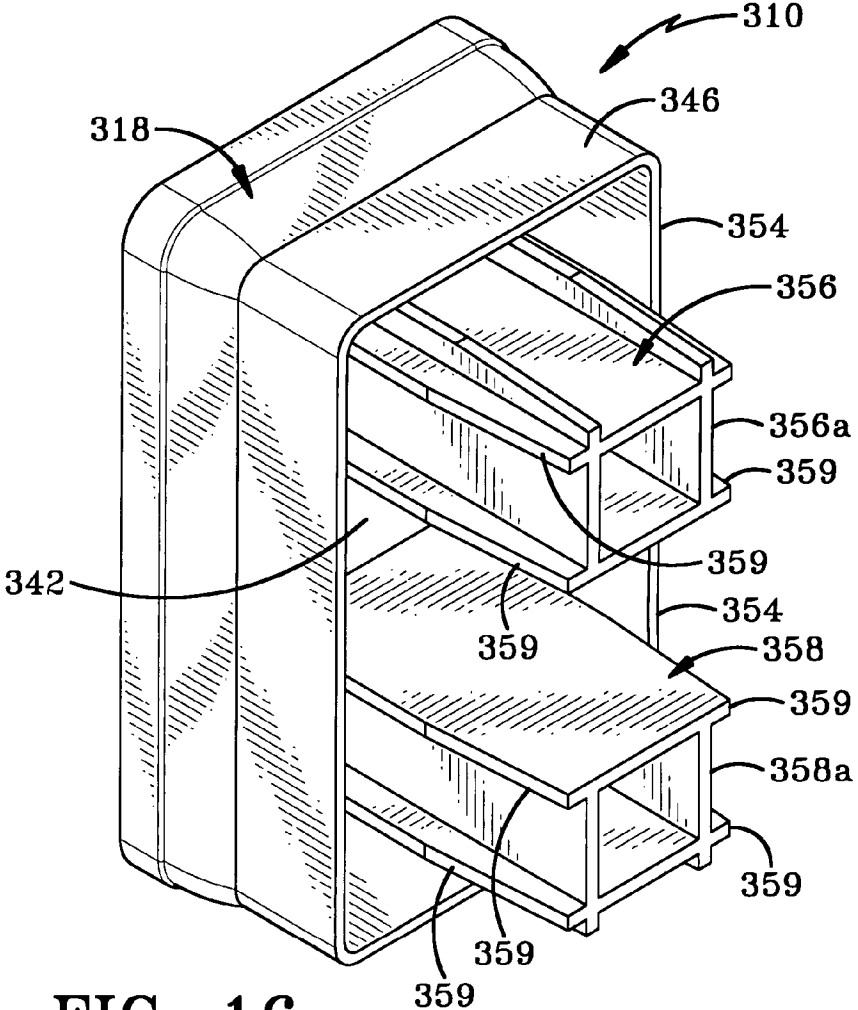
FIG. 16 is a perspective view of a third embodiment of the fence rail clip in accordance with the present invention.

A third embodiment of rail clip in accordance with the present invention is shown in FIG. 16 and generally indicated at 310. Rail clip 310 includes a bracket 318 having a front surface 342 and a peripheral wall 346. A pair of rail supports 356 and 358 extend outwardly from front surface 342 and from within the perimeter of peripheral wall 346. Rail supports 356 and 358 are separated from each other and from peripheral wall 346. The outer edges 356*a* and 358*a* of supports 356, 358 lie further from front surface 342 than does the outer edge 354 of peripheral wall 346. Rail supports 356, 358 include tapered flanges as at 359 which allows for easier engagement with a rail (not shown). The third embodiment of rail clip 310 functions in essentially the same manner as the first and second embodiments thereof.

Figure 17:
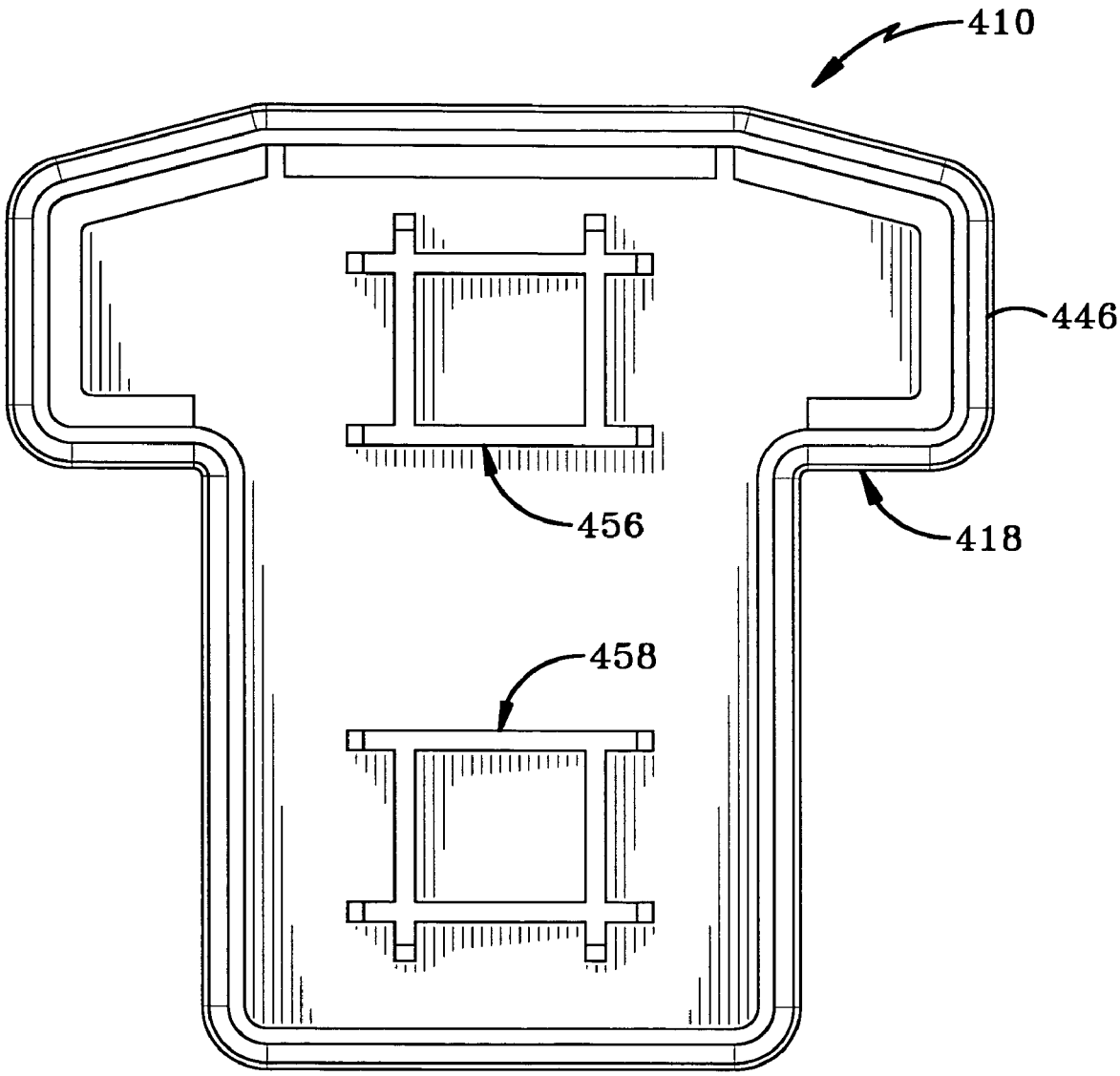
FIG. 17 is a front view of a fourth embodiment of the fence rail clip in accordance with the present invention.

Referring to FIG. 17, there is shown a fourth embodiment of rail clip in accordance with the present invention and generally indicated at 410. This embodiment includes rail supports 456 and 458 which are essentially identical to rail supports 356 and 358 shown in FIG. 16. The bracket 418 and associated peripheral wall 446, however, are not rectangularly shaped as with the previously described embodiments. Rail supports 456, 458 are separated from each other and separated from peripheral wall 446 as with previous embodiments. The rail (not shown) is complementary sized and shaped to interlock with bracket 418 and the rail is received in the gap formed between rail supports 456, 458 and peripheral wall 446.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A fence rail mounting clip for attaching an end of an elongated fence rail to a fence post, the fence rail having opposing end walls connected together by opposing side walls, the end walls and side walls defining a longitudinal axial bore therebetween; and wherein said fence rail mounting dip comprises:

a bracket having a rear surface and a front surface;

a peripheral wall extending outwardly from the front surface of the bracket; whereby the peripheral wall and front surface of the bracket define a fence rail receptacle which is adapted to receive the end of the rail therein;

a first rail support extending outwardly away from the front surface of the bracket and from within the rail receptacle; the first rail support being separated from the peripheral wall by a gap; and wherein the first rail support is adapted to extend into the rail bore when the rail's end walls and side walls are received within the gap; and wherein the peripheral wall includes an outermost edge spaced a first distance from the front surface of the bracket, and the first rail support includes an outermost edge spaced a second distance from the front surface of the bracket and the second distance is larger than the first distance; and wherein the first rail support comprises:

an elongated rib extending outwardly away from the front surface of the bracket, the rib having an outer wall; and a first flange extending outwardly from the outer wall and toward the peripheral wall, and wherein the first flange is adapted to engage one of the side and end walls of the rail; and wherein the first flange extends outwardly from the rib along the entire length thereof and wherein the first flange terminates in a ridge and at least a portion of the ridge is tapered.

2. The fence rail mounting clip as defined in claim 1, further comprising a second rail support disposed within the rail receptacle and extending outwardly from the front surface of the bracket; and wherein the second rail support is separated from the first rail support by a space; and wherein the second rail support is separated from the peripheral wall by a second gap; and wherein both the first and second rail supports are adapted to extend into the rail bore when the rail's end walls and side walls are received within the first and second gaps.

3. The fence rail mounting clip as defined in claim 2, wherein the second rail support has an outermost edge spaced a third distance from the front surface of the bracket; and the third distance is at least as large as the first distance.

4. The fence rail mounting clip as defined in claim 3, wherein the third distance is larger than the first distance.

5. The fence rail mounting clip as defined in claim 4, wherein the third distance is substantially the same as the second distance.

6. The fence rail mounting clip as defined in claim 1, wherein the first rail support comprises:

an elongated rib extending outwardly away from the front surface of the bracket, the rib having an outer wall; and a first flange extending outwardly from the outer wall and toward the peripheral wall, and wherein the first flange is adapted to engage one of the side and end walls of the rail.

7. The fence rail mounting clip as defined in claim 6, wherein the first flange extends outwardly from the rib along the entire length thereof.

8. The fence rail mounting clip as defined in claim 1, wherein the rib further includes a side wall and the side wall of the rib is adapted to engage the other of the side and end walls of the rail.

9. The fence rail mounting clip as defined in claim 8, wherein the side wall of the rib has a front end proximate the outermost edge of the first rail support; and the front end of the side wall is tapered.

10. The fence rail mounting clip as defined in claim 1, further comprising a base having a rear surface and a front surface; and wherein the rear surface of the base is adapted to abut the fence post.

11. The fence rail mounting clip as defined in claim 10, further comprising an attachment means, wherein the attachment means secures the base to the fence post.

12. The fence rail mounting clip as defined in claim 11, wherein the base and bracket engage each other.

13. The fence rail mounting clip as defined in claim 12, further comprising a second attachment means for securing the base and bracket together, wherein the second attachment means includes an inner peripheral edge formed in the bracket and an outer peripheral edge formed in the base; the inner peripheral edge and outer peripheral edge being complementary sized and shaped to engage each other.

14. The fence rail mounting clip as defined in claim 13, wherein the rear surface of the base is adapted to be positioned adjacent the fence post and the inner peripheral edge of the bracket and outer peripheral edge of the base are adapted to operatively interlock to retain the bracket adjacent the base.

15. The fence rail mounting clip as defined in claim 14, wherein the inner peripheral edge extends around a recessed portion of the bracket; and the recessed portion is complementary sized and shaped to receive the base therein.

16. The fence rail mounting clip as defined in claim 15, in which the recessed portion is open at one end for slidably receiving the base therein.

17. The fence rail mounting clip as defined in claim 1, wherein the peripheral wall includes an outermost edge spaced a first distance from the front surface of the bracket; and the first rail support includes an outermost edge spaced a second distance from the front surface of the bracket and the second distance is larger than the first distance.

18. The fence rail mounting clip as defined in claim 1, wherein the bracket defines an aperture that extends between the front and rear surfaces thereof; and the clip further comprises a base that interlockingly engages in the aperture in the bracket; and wherein the base is adapted to be secured to the fence post.

19. A fence rail mounting clip for attaching an end of an elongated fence rail to a fence post, the fence rail having opposing end walls connected together by opposing side walls, the end walls and side walls defining a longitudinal axial bore therebetween; and wherein said fence rail mounting clip comprises:

a bracket having a rear surface and a front surface;

a peripheral wall extending outwardly from the front surface of the bracket; whereby the peripheral wall and front surface of the bracket define a fence rail receptacle which is adapted to receive the end of the rail therein;

a first rail support extending outwardly away from the front surface of the bracket and from within the rail receptacle; the first rail support being separated from the peripheral wall by a gap; and wherein the first rail support is adapted to extend into the rail bore when the rail's end walls and side walls are received within the gap; and wherein the peripheral wall includes an outermost edge spaced a first distance from the front surface of the bracket; and the first rail support includes an outermost edge spaced a second distance from the front surface of the bracket and the second distance is larger than the first distance; and wherein the first rail support comprises:

an elongated rib extending outwardly away from the front surface of the bracket, the rib having an outer wall and a side wall, and the side wall of the rib is adapted to engage the other of the side and end walls of the rail;

a first flange extending outwardly from the outer wall and toward the peripheral wall, and wherein the first flange is adapted to engage one of the side and end walls of the rail; and a protrusion extending outwardly from the side wall of the rib and toward the peripheral wall of the bracket, and wherein the protrusion is adapted to engage the other of the side and end walls of the rail.

20. The fence rail mounting clip as defined in claim 19, further comprising a second rail support disposed within the rail receptacle and extending outwardly from the front surface of the bracket; and wherein the second rail support is separated from the first rail support by a space; and wherein the second rail support is separated from the peripheral wall by a second gap; and wherein both the first and second rail supports are adapted to extend into the rail bore when the rail's end walls and side walls are received within the first and second gaps.

21. The fence rail mounting clip as defined in claim 20, wherein the second rail support comprises a second rib having an outer wall and a second flange that extends outwardly away therefrom and toward the peripheral wall of the bracket; and wherein the second flange of the second rail support originates proximate the front surface of the bracket and terminates proximate an outermost front end of the second rib.

22. The fence rail mounting clip as defined in claim 19, wherein the bracket defines an aperture that extends between the front and rear surfaces thereof; and the clip further comprises a base that interlockingly engages in the aperture in the bracket; and wherein the base is adapted to be secured to the fence post.

23. A fence rail mounting clip for attaching an end of an elongated fence rail to a fence post, the fence rail having opposing end walls connected together by opposing side walls, the end walls and side walls defining a longitudinal axial bore therebetween; and wherein said fence rail mounting clip comprises;

a bracket having a rear surface and a front surface;

a peripheral wall extending outwardly from the front surface of the bracket; whereby the peripheral wall and front surface of the bracket define a fence rail receptacle which is adapted to receive the end of the rail therein;

a first rail support extending outwardly away from the front surface of the bracket and from within the rail receptacle; the first rail support being separated from the peripheral wall by a gap; and wherein the first rail support is adapted to extend into the rail bore when the rail's end walls and side walls are received within the gap; and wherein the peripheral wall includes an outermost edge spaced a first distance from the front surface of the bracket; and the first rail support includes an outermost edge spaced a second distance from the front surface of the bracket and the second distance is larger than the first distance; and wherein the first rail support comprises:

an elongated rib extending outwardly away from the front surface of the bracket, the rib having an outer wall; and a first flange extending outwardly from the outer wall and toward the peripheral wall, and wherein the first flange is adapted to engage one of the side and end walls of the rail; and a second rail support separated from the first rail support by a space, and wherein the first and second rail supports extend from the bracket front surface adjacent each other and are separated by a space; and wherein the second rail support comprises a rib having an outer wall and a flange extending outwardly therefrom and toward the peripheral wall of the bracket; and wherein the flange of the second rail support is adapted to engage one of the side and end walls of the rail.

24. The fence rail mounting clip as defined in claim 23, wherein the ribs of both of the first and second rail supports each have an inner wall and a second flange extends outwardly from the inner wall of each of the first and second rail supports and into the space therebetween.

25. The fence rail mounting clip as defined in claim 24, wherein the second flange of each rib extends outwardly from the inner wall along the entire length of the rib.

26. The fence rail mounting clip as defined in claim 23, wherein both of the first and second ribs are hollow.

27. The fence rail mounting clip as defined in claim 23, wherein the ribs of each of the first and second rail supports include a plurality of longitudinally aligned chambers separated from each other by connecting walls.

* * * * *